BEST AVAILABLE COPY

United States Patent [19]

Warren et al.

[11] Patent Number: 4,660,656

[45] Date of Patent: Apr. 28, 1987

[54] METHOD AND APPARATUS FOR CONTROLLING THE ROTATIONAL TORQUE OF A DRILL BIT

[75] Inventors: Tommy M. Warren, Coweta; Warren J. Winters; J. Ford Brett, both of Tulsa, all of Okla.

[73] Assignee: Amoco Corporation, Chicago, Ill.

[21] Appl. No.: 801,163

[22] Filed: Nov. 22, 1985

[51] Int. Cl.[4] ..... E21C 5/00

[52] U.S. Cl. ..... 175/26; 175/27; 173/8; 173/9

[58] Field of Search ..... 175/26, 27, 38; 173/5, 173/6, 7, 8, 9

[56] References Cited

U.S. PATENT DOCUMENTS

| | | | |
|---|---|---|---|
| 1,935,105 | 11/1933 | Wooller | 175/27 |
| 3,550,697 | 12/1970 | Hobhouse | 173/9 |
| 3,593,807 | 7/1971 | Klima | 175/27 |
| 4,165,789 | 8/1979 | Rogers | 173/9 |
| 4,195,699 | 4/1980 | Rogers et al. | 173/9 |

FOREIGN PATENT DOCUMENTS

| | | | |
|---|---|---|---|
| 0781328 | 11/1980 | U.S.S.R. | 175/27 |

*Primary Examiner*—Stephen J. Novosad
*Assistant Examiner*—William P. Neuder
*Attorney, Agent, or Firm*—Scott H. Brown; Fred E. Hook

[57] ABSTRACT

A method and apparatus for controlling the rotational torque of a drill bit powered by a downhole motor. The downhole motor is suspended from a hydraulic ram at the lower end of a string of drill pipe. A torque sensor detects the reactive torque in the downhole motor during drilling. In response to the detected torque level, pressurized drilling fluid from the downhole motor is provided to the hydraulic ram thereby varying the weight applied to the drill bit in order to maintain a constant torque level.

29 Claims, 13 Drawing Figures

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

BEST AVAILABLE COPY

METHOD AND APPARATUS FOR CONTROLLING THE ROTATIONAL TORQUE OF A DRILL BIT

BACKGROUND OF THE INVENTION

1. Field of the Invention

The present invention relates to methods and apparatus for controlling the penetration rate of a drill bit and more particularly to such methods and apparatus which use a fluidic ram to vary the weight applied to the drill bit.

2. Setting of the Invention

In the drilling of oil and gas wells, a common equipment configuration includes a drill bit mounted on the lower end of a downhole hydraulic motor (such as a turbine or positive displacement motor) which is suspended from the lower end of a string of drill pipe. Drilling fluid is pumped through the drill pipe to the motor. The motor is powered by fluid flowing through it and thereby rotates the drill bit. The drilling fluid continues its downward flow through openings in the lower end of the drill bit. The drilling fluid serves to power the motor as well as to cool the drill bit and to flush cuttings from the bottom of the wellbore upwardly to the surface in the annulus between the drill string and the bore.

When using a downhole motor of the turbine type in the above-described configuration, it is desirable to operate the downhole motor at its maximum power. Such operation occurs when the downhole motor output shaft or rotor is spinning at approximately one-half of its runaway or no-load speed. When so operating, the downhole motor is applying a constant torque to the drill bit and this is true regardless of variations in rock properties and bit wear.

There is an approximately direct relationship between the torque delivered to the drill bit and the amount of weight applied to the bit. The drill bit weight required to maintain the desired torque level varies with changes in rock properties and drill bit dullness. Thus, the downhole motor may be operated at its maximum power by maintaining the torque applied to the drill bit at the constant level at which maximum power is delivered.

Several problems are encountered when drilling with a downhole motor as described above. It is difficult to know whether the desired torque level is being applied to the drill bit because there is little indication at the surface of the torque being applied to the drill bit. Also, it is difficult to accurately measure the weight applied to the drill bit at the surface due to wellbore friction acting on the drill string. Although there exist commercially available devices for measuring weight applied to the drill bit and drill bit torque at the bit, when such are used to transmit information to the surface to vary the force used to suspend the drill string (which in turn varies the weight applied to the bit), the response time is insufficient to avert drill bit failure when the property of rock through which the bit is drilling suddenly changes.

In the past, downhole hydraulic rams have been incorporated into the drill string above the drill bit to apply a downward force to the bit. Such past hydraulic rams are pressurized by a pump powered by the downhole motor or by the pressure of the drilling fluid in the drill string and are thus not acting directly in response to torque applied to the drill bit. Moreover, such past hydraulic rams are pressurized to urge the bit downwardly relative to the drill string and thus prevent an accurate measurement of the weight applied to the bit at the surface. In addition, it is difficult to determine at the surface of the well when to advance drill pipe because the position of the piston in the ram relative to the drill string cannot be accurately determined.

There exists a need for a method and apparatus for controlling the penetration rate of a drill bit in which the rate is controlled to obtain a constant drill bit torque. Moreover, there exists a need for such a method and apparatus in which the weight applied to the bit, and thus the torque, is varied by a downhole fluidic ram which acts in response to drill bit torque. Further, there exists a need for such a method and apparatus which may be powered downhole without addition of a pump. Finally, there exists a need for such a method and apparatus which provides an indication of when to advance the drill pipe and which permits accurate measurement of weight applied to the drill bit.

SUMMARY OF THE INVENTION

The present invention comprises a novel method and apparatus for controlling the penetration rate of a drill bit by varying the weight applied to the bit. The apparatus of the invention includes means for sensing the torque applied to the drill bit and a downhole hydraulic ram in which pressurized fluid is provided in response to the sensed torque level. As the torque increases, the ram moves to decrease the weight applied to the bit and vice versa. In one aspect of the invention, drilling fluid pressure differential across the downhole motor which rotates the drill bit is used as a power source to provide pressurized fluid to the ram.

The present invention is particularly useful for maintaining a constant preselected drill bit torque on a drill bit powered by a downhole hydraulic motor.

BEST AVAILABLE COPY

Figure 12:
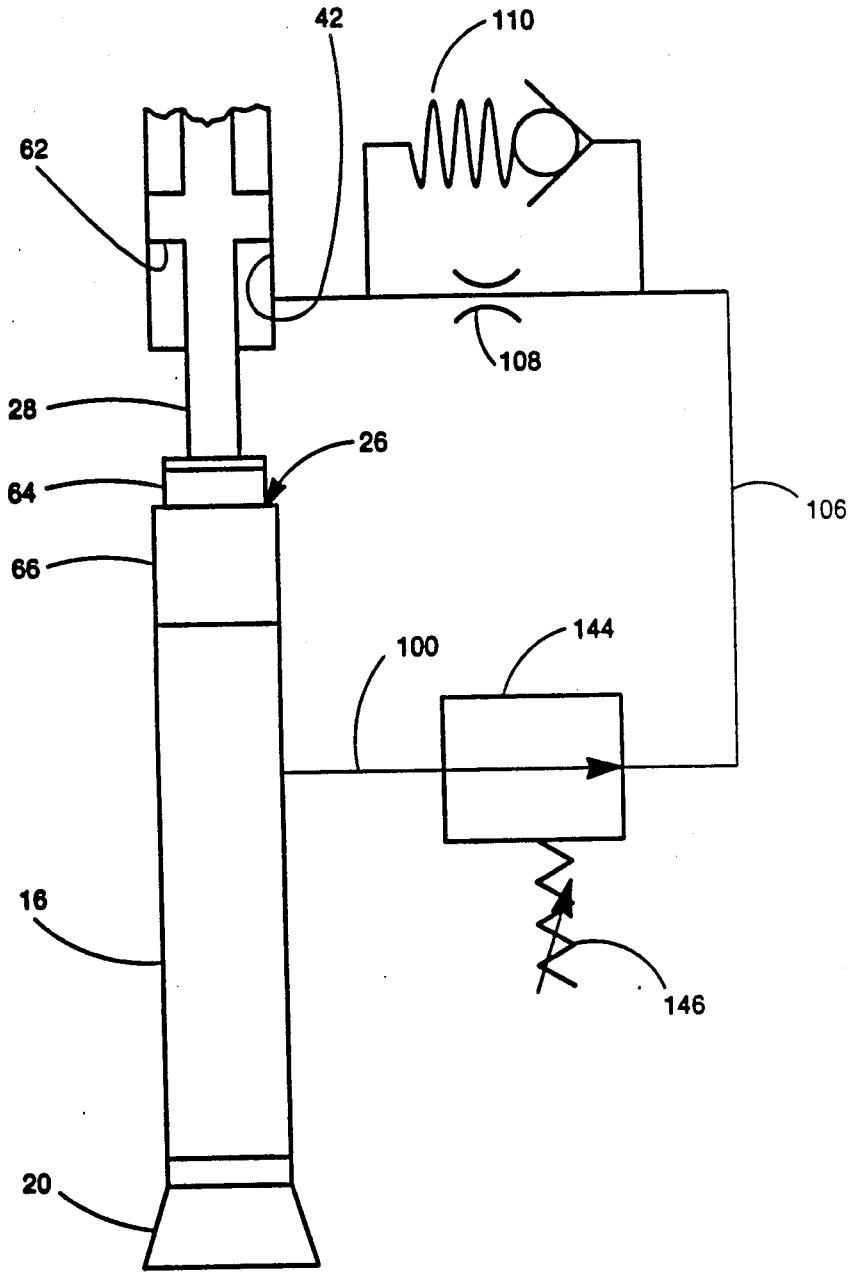

FIG. 12 is a portion of the hydraulic controls for yet another preferred embodiment of the apparatus of the invention.

Figure 13:
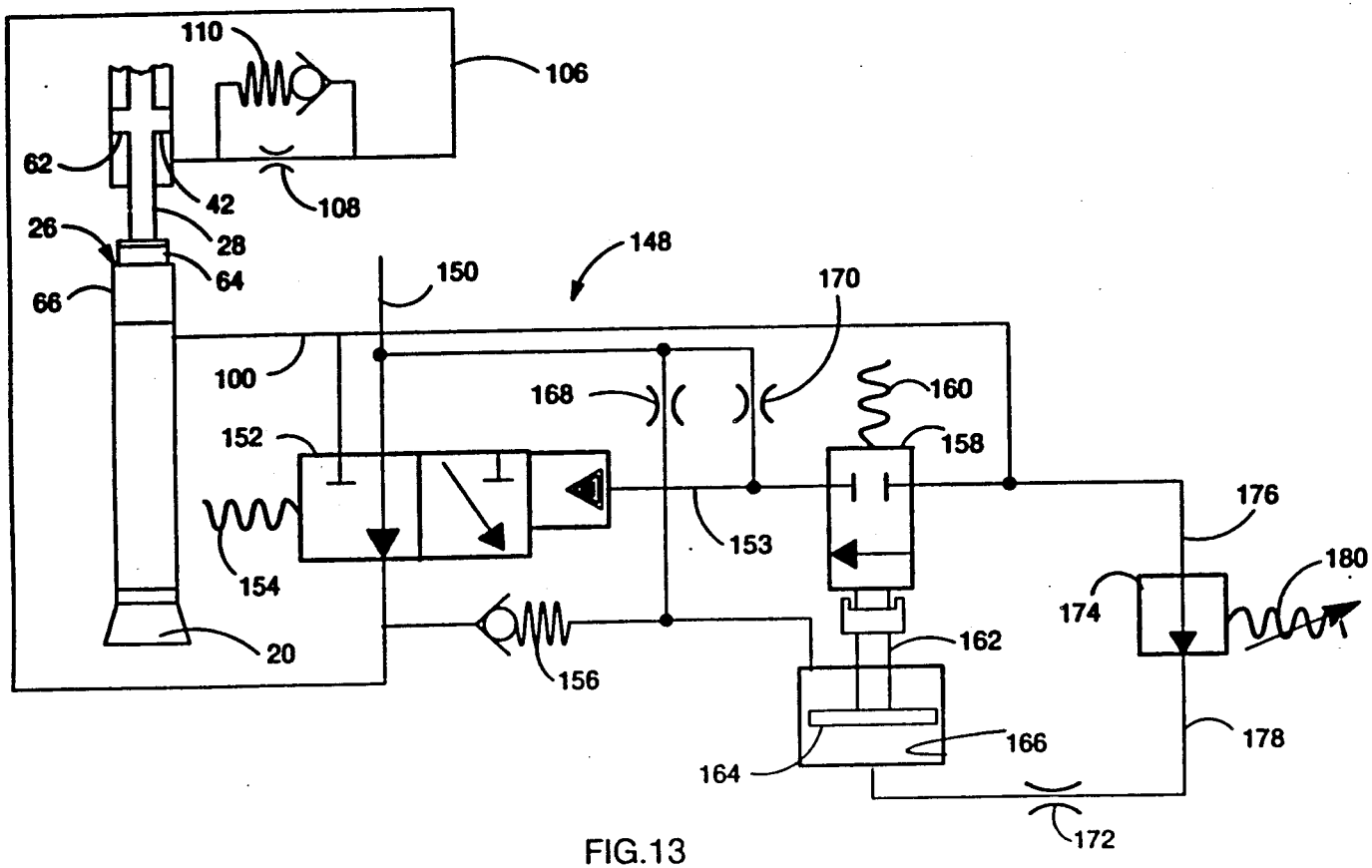

FIG. 13 is a schematic diagram of the hydraulic controls for still one more preferred embodiment of the apparatus of the invention.

DETAILED DESCRIPTION OF THE PREFERRED EMBODIMENTS

The present invention provides a method and apparatus for controlling the penetration rate of a drill bit by varying the force applied to the drill bit by a downhole hydraulic ram. Torque applied to the drill bit is sensed and fluid pressure is generated in the ram responsive to the sensed torque level. The pressure differential between drilling fluid entering a downhole motor, which is used to power the drill bit, and the fluid exiting the downhole motor creates a source of fluid at different pressures which is used to energize the ram.

Indicated generally at 10 is a wellbore having a string of drill pipe 12 suspended therein. Firmly threadable engaged with the lower end of pipe string 12 is a device 14, constructed in accordance with the apparatus of the instant invention. A downhole motor 16 is firmly threadable engaged to the lower end of device 14 via threaded connection 18. Mounted on the lower end of downhole motor 16 is a commercially available drill bit 20.

Briefly stated, in operation, drilling fluid is pumped through drill pipe 12 and device 14 to downhole motor 16. The downhole motor is powered by drilling fluid passing therethrough which causes rotation of drill bit 20. Drilling fluid 22 passes through openings at the lower end of drill bit 20 and moves upwardly in annulus 24 between drill pipe 12 and the wellbore. In a manner which will be hereinafter more fully described, device 14 senses the torque applied by downhole motor 16 to drill bit 20 and varies the weight applied to the drill bit, by raising and lowering downhole motor 16, to obtain a constant drill bit torque.

Figure 2:
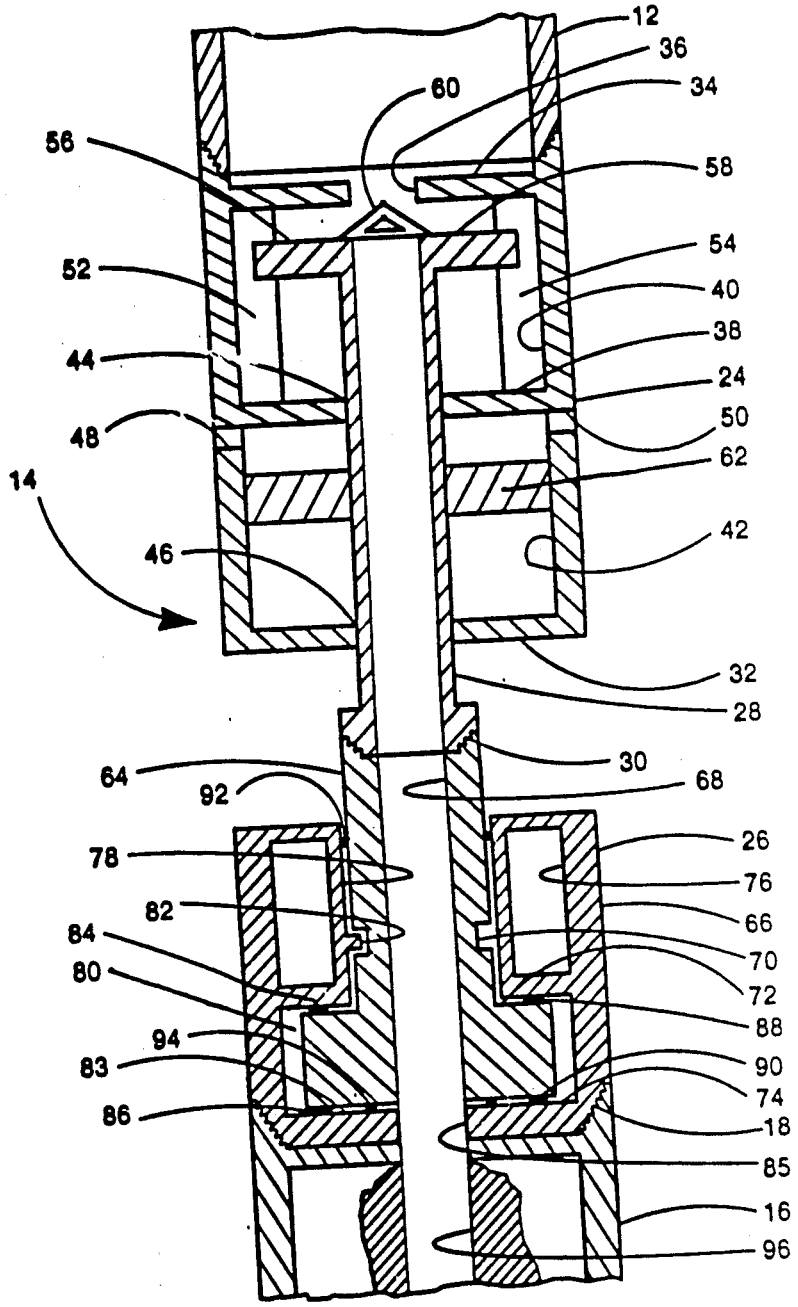
FIG. 2 is an enlarged cross-sectional view of a portion of the embodiment of FIG. 1.

Turning now to FIG. 2, device 14 includes therein a tubular assembly 24 and a torque sensor 26 which are connected to one another via a tube 28 that is threadably engaged to torque sensor 26 by threaded connection 30.

Tubular assembly 24 is generally cylindrically shaped and includes a bottom plate 32, through which tube 28 is sealingly received, and a top plate 34 having a round opening 36 centered thereon. A divider plate 38 separates the interior of tubular assembly 24 into an upper cylinder 40 and a lower cylinder 42. A seal 44 provides a fluid-tight seal between tube 28 and the opening a plate 38 through which the tube is received. In a similar manner, a seal 46 seals between tube 28 and the opening in bottom plate 32 through which the tube is received. A pair of ports 48, 50 permits fluid communication between the interior of the upper portion of cylinder 42 and the annulus in the wellbore. Screens (not visible) are provided in ports 48, 50 to prevent particle entry into chamber 42. In chamber 40, a plurality of upright members, two of which are members 52, 54, are rigidly fixed between plates 34, 38.

Members 52, 54 interact with a plurality of splines, two of which are splines 56, 58, which are rigidly mounted on top of tube 28, to prevent rotational movement of tube 28 while permitting axial movement, within defined limits, relative to tubular assembly 24. A perforated conical element 60 is mounted on top of tube 28. Element 60 permits fluid flow through the tube but, as will later be more fully described, tends to restrict opening 36 in plate 34 as it approaches the opening. A piston 62 is rigidly mounted on tube 28 and is sealingly engaged about its circumference with cylinder 42.

Torque sensor 26 includes an inner housing 64 and an outer housing 66. The inner housing includes a bore 68 therethrough which is in coaxial alignment with the bore in tube 28. An annular groove 70 is formed about the circumference of the inner housing as shown. Groove 70 includes therein a stop (not visible) which spans the groove and which cooperates with structure on outer housing 66, to be later described, to limit the range of relative rotational movement between the inner and outer housing. Inner housing 64 also includes an annular shoulder 72 about the circumference thereof and a lower end 74.

Outer housing 66 includes a radially outer surface which is substantially cylindrically shaped. The outer housing includes an annular cavity 76 into which hydraulic controls (not shown in FIG. 2), to be later described, are received. The outer housing further includes a pair of generally cylindrically shaped upper and lower cavities 78, 80 into which inner housing 64 is received as shown. Upper cavity 78 includes a stop 82 which is received within groove 70 of the inner housing. When the inner housing rotates approximately 270 degrees in a counterclockwise direction (as viewed from the surface of the well), stop 82 contacts with previously mentioned stop (not visible) in groove 70 thus limiting further relative rotational movement of the inner and other housings. Outer housing 66 includes an end plate 83, which forms the lower portion of the housing, and a circular opening 85 therethrough. Opening 85 is substantially coaxial with bore 68 in the inner housing.

Four thrust bearings 84, 86, 88, 90 are interposed between inner housing 64 and the interior of the outer housing as shown and serve to prevent relative axial movement of the housings while permitting relative rotational movement as described above. Annular seals 92, 94, seal the space between the inner and outer housings from the fluids in the wellbore.

Turbine 16 includes therein a bore 96 which is coaxial with an opening in the top of the downhole motor; and with opening 85, bore 68, and tube 28. Thus when fluid is pumped through the drill string, it enters downhole motor 16 via bore 96 and cooperates with structure in the downhole motor (not shown) in the usual manner to rotate the downhole motor drive shaft on which drill bit 20 (in FIG. 1) is mounted.

Figure 3:
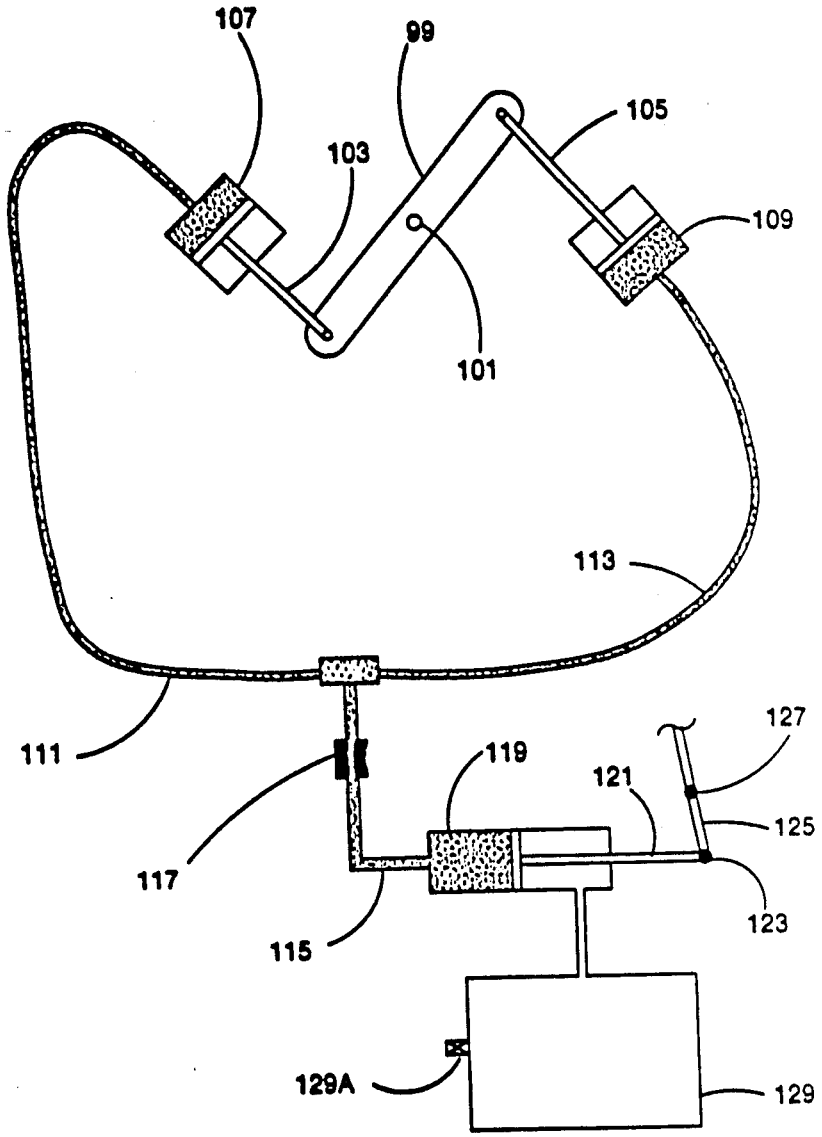
FIG. 3 is a somewhat schematic diagram of a portion of an alternate embodiment of FIG. 1.

Turning now to FIG. 3, a portion of the structure is received within a torque sensor 26, in FIG. 2, and which is not shown, for the sake of clarity, in the other figures. Included therein is a torque arm 99 which is mounted on rod 101. Rod 101 is securely connected to inner housing 64 of the torque senor. The ends of arm 99 are pivotally connected to rods 103, 105, each of which has its other end connected to a piston in cylinders 107, 109, respectively. Cylinders 107, 109 are each mounted on outer housing 66 of the torque senor. Thus, relative rotational movement of the inner and outer housings moves each piston in its associated cylinder. The cylinders are connected to hoses 111, 113, as shown, which are filled with hydraulic fluid. Hoses 111, 113 are in turn connected to a conductor 115 having a flow-restricting orifice 117 therein. Conductor 115 is connected to cylinder 119 which has a piston and rod 121 as shown. Rod

BEST AVAILABLE COPY 121 is pivotally connected via connection 123 to a linkage 125 which is rotatable above pivot pint 127. The end of linkage 125 opposite connection 123 is pivotally connected to hydraulic controls (not shown in FIG. 3) shown in FIG. 5. The end of cylinder 119 opposite its connection to conductor 115 is in fluid communication with a gas reservoir 129 which is charged to a preselected pressure with a gas such as nitrogen. A pressure relief valve 129*a* permits release of gas in reservoir 129 when pressure therein rises above the preselected pressure. Reservoir 129 has a volume at least 100 times greater than cylinder 119 so that the changes in the pressure in the reservoir is negligible as the piston in cylinder 119 is moved.

Figure 4:
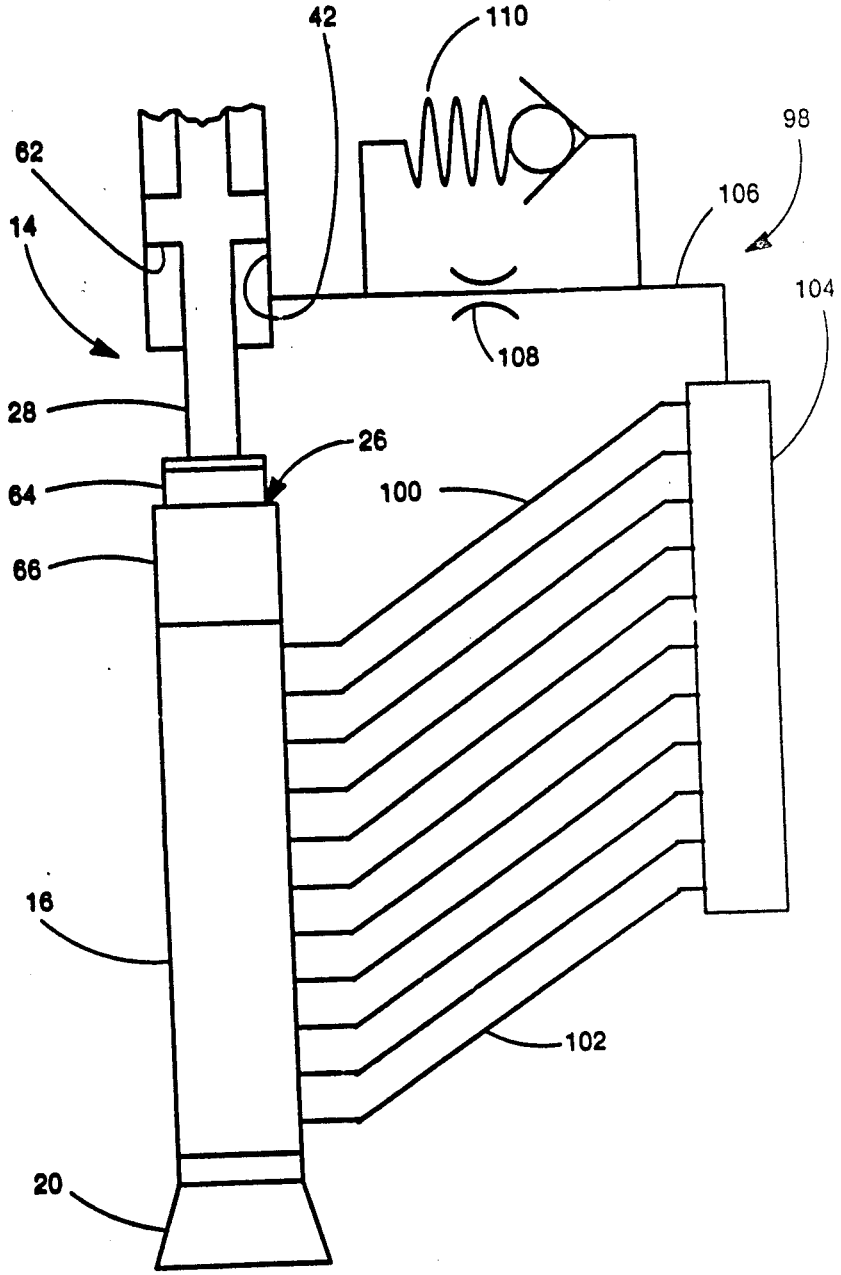
FIG. 4 is a somewhat schematic diagram of the hydraulic controls for the alternate embodiment of FIG. 1.

Turning now to FIG. 4, structure which has been previously numbered and identified is again identified by the same number. Indicated generally at 98 in FIG. 4 is control circuitry which is depicted in a schematic manner. Included therein are a plurality of hydraulic conductors, two of which are conductors 100, 102, each of which has one end connected to downhole motor 16 at various positions along the length thereof and another end connected to a conductor selector 104.

When fluid is flowing through the downhole motor, it enters the top of the downhole motor at a relatively high pressure and exists the lower end thereof at a low pressure. The pressure drop across the downhole motor is substantially linear and thus, each of the conductors, like conductors 100, 102, delivers drilling fluid at a different pressure to selector 104 with conductor 100 containing the highest pressure and conductor 102 containing the lowest pressure and each of the intervening conductor containing a different pressure between the high and low pressure conductors.

Figure 5:
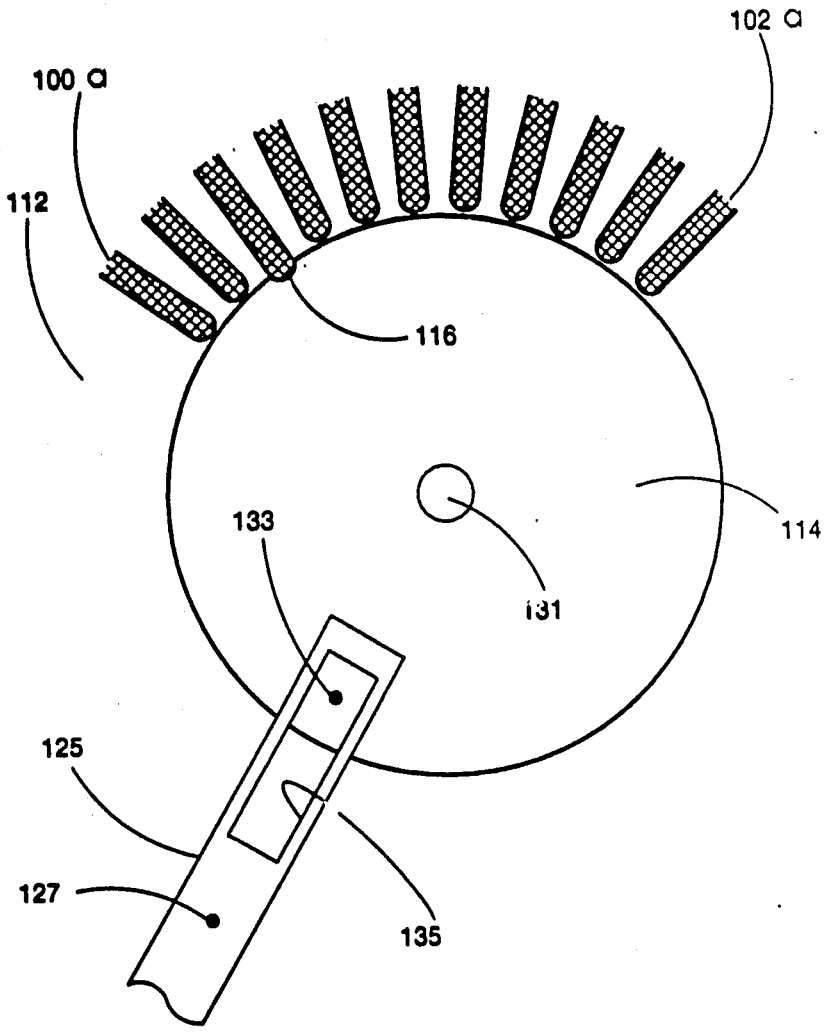
FIG. 5 is a plan view of a portion of hydraulic control for the alternate embodiment of FIG. 1.
Figure 6:
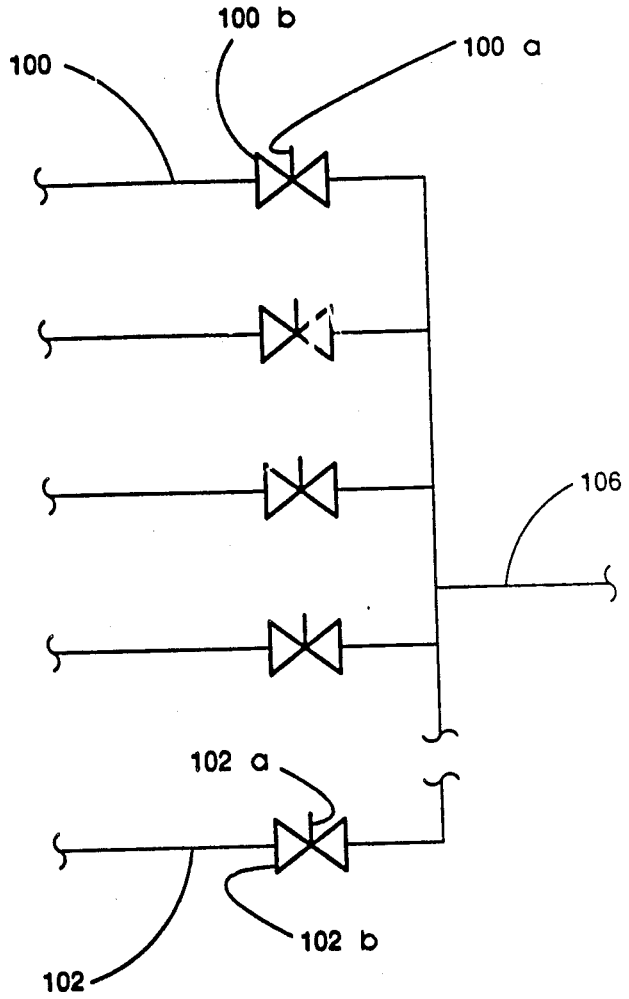
FIG. 6 is a schematic drawing of additional hydraulic controls for the embodiment of FIG. 1.

Selector 104 has connected thereto an output conductor 106 which in turn is connected to cylinder 42 beneath piston 62. An orifice 108 and a check valve 110 are connected in parallel in conductor 106 between selector 104 and cylinder 42. Check valve 110 permits wide open flow from right to left, as viewed in FIG. 3, and prevents any flow from left to right. Orifice 108 restricts flow in either direction along conductor 106. Turning now to FIGS. 5 and 6, consideration will be given to one form which selector 104 may take.

Indicated generally at 112 in FIG. 5 is a portion of one form of selector 104. Included therein is a rotatable actuator selector 114. Actuator selector 114 takes the form of a round disc having a recessed portion 116 on its circumference. Actuator selector 114 is mounted on a rod 131 for rotation about the axis thereof. An upright pin 133 is mounted on selector 114 and is received within a slot 135 on one end of linkage 125. Thus, rotation of linkage 125 about pivot point 127 causes rotation of selector 114 are a plurality of valve actuators, two of which are actuators 100*a*, 102*a*, which are associated with conductors 100, 102 (in FIG. 4), respectively. Each of the other actuators is associated with a different conductor, like conductors 100, 102. Each of the actuators is spring biased against selector 114 and serves to actuate an associated valve (not shown in FIG. 5) when recessed portion 116 is adjacent the actuator with which the valve is associated. When such occurs, the actuator is received within the recessed portion, as shown in FIG. 5, and the associated valve is opened.

Turning now to FIG. 6, shown schematically therein are a plurality of valves, two of which are valves 100*b*, 102*b*, each of which is connected to an associated conductor, like valve 100*b* is connected to conductor 100 and valve 102*b* is connected to conductor 102. Each of the valves is a commercially available valve which remains in a closed position unless its associated actuator is received within recess 116 on selector 114 in which case the valve opens. Thus, selector 114 selectively opens one and only one of the valves depending upon the rotational position of the selector.

Figure 1:
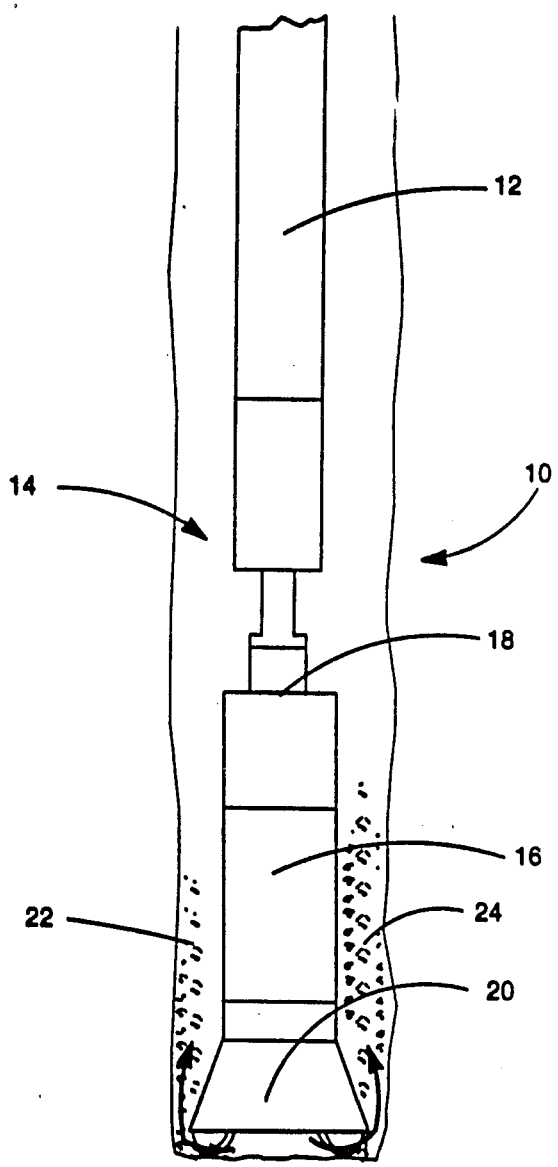
FIG. 1 is an elevational view of a preferred embodiment of the apparatus of the invention in a wellbore.

Considering now the operation of the embodiment of the apparatus of the invention illustrated in FIGS. 1-6, drill string 12 (and the structure depending therefrom) is lowered to the position shown in FIG. 1. During lowering, piston 62 abuts against bottom plate 32 of tubular assembly 24. When bit 20 hits the bottom of the bore, additional lowering transfers the weight of the downhole motor and plurality of weighted pipes inserted between motor 16 and connection 18 to the bit as piston 62 moves to the position shown in FIG. 2.

As drilling fluid is pumped through drill string 12 when the apparatus is in the conditions shown in FIGS. 1 and 2, drill bit 20 rotates thus drilling wellbore 10 deeper. During drilling, since the drillstring 12 is held at the surface, the tubular assembly 24, tube 28, and inner housing 64 of torque sensor 26 remain fixed against rotational movement due to the action of the splines, like splines 56, 58 at the top of tube 28, against members 52, 58. However, outer housing 66 of the torque sensor and downhole motor 16 are free to rotate relative to the remainder of the drill string. Such rotation results from the reactive torque in the downhole motor during drilling. In other words, as the downhole motor shaft applies torque to the drill bit, the body of the downhole motor tends to rotate in the opposite direction as a result of the reactive torque. As the torque applied to the drill bit increases so does the force of the reactive torque. In FIG. 2, assuming clockwise drill bit rotation as viewed form the top of the bore, downhole motor 16 tends to rotate counterclockwise relative to inner housing 64. This pressurizes the fluid in cylinders 107, 109 in FIG. 3.

For a given amount of torque in the drill bit, the outer housing of the torque sensor is proportionally angularly displaced. As will be recalled, stop 82 interacts with a stop in groove 70 (not visible) to limit maximum angular displacement to 270 degrees. Turbine operation is optimized at a selected constant level of torque applied to the bit. If this torque level is achieved, the outer housing of the torque sensor, and hence the downhole motor which is attached to the lower end thereof, will operate at a constant angular displacement relative to the inner housing. The pressure in reservoir 129 has been selected to equal the pressure exerted by the hydraulic system at the desired operating torque. In the instant embodiment of the invention, the angular displacement between a no-torque condition and a drilling condition at which the optimum torque level is achieved is approximately 120 degrees.

As drilling progresses, varying rock properties are encountered and bit wear increases. Both of these changeable parameters require that weight applied to the bit change in response thereto to maintain a constant drill bit torque. When, for example, softer rock is encountered, the torque tends to increase thus causing rotation of outer housing 66 and torque arm 99. As the torque arm rotates, pressure in cylinders 107, 109 increases until the pressure of the hydraulic fluid in cylinder 119 is greater than the pressure in reservoir 129. When such occurs, rod 121 moves rightwardly whereby rotating actuator selector 114. As the actuator selector rotates, one of the valves, like valves 100*b*,

BEST AVAILABLE COPY 102b, is actuated to provide drilling fluid from a conductor having a higher pressure to conductor 106. Such increases the pressure in cylinder 42 and thus increases upward pressure against piston 62 thereby decreasing the weight applied to the bit and hence the torque. If, on the other hand, harder rock is encountered, the torque decreases thereby causing relative rotation of outer housing 66 in the opposite direction. Such decreases pressure in cylinders 107, 109 thus permitting leftward movement of rod 121 and rotation of actuator selector 114. Such movement opens a valve associated with a conductor having a lower fluid pressure thereby providing such lower pressure to cylinder 42 via conductor 106. As the pressure in cylinder 42 decreases, the weight applied to drill bit 20 increases. Orifice 108 restricts the rate at which fluid may flow from cylinder 42 thereby preventing a sudden increase in weight applied to the bit, which might damage the bit. Check value 110 permits rapid introduction of fluid via conductor 106 into cylinder 42 in the event that a sudden high torque level is sensed thereby rapidly decreasing the weight applied to the bit in order to avoid bit damage.

When the weight applied to the bit is such that the desired bit torque is achieved, the pressure of the hydraulic fluid equals the pressure of the gas in reservoir 129 and the selected valve position is maintained until a change in torque causes a self-correcting adjustment as described above. Orifice 117 is selected to dampen the system's dynamic response. Appropriate design of the orifices 108 and 117 by a person having ordinary skill in the art can provide relatively rapid decrease of the weight applied to the bit as opposed to more gradual increases of the applied weight.

As drilling progresses, the drill string is periodically lowered to prevent piston 62 from abutting bottom plate 32 of tubular assembly 24. When the drill string is lowered, element 60 approaches opening 36 which restricts drilling fluid flow and thus provides a pressure increase at the well surface to signal that the drill string should be fixed against further lowering. Thereafter, drilling continues as described above.

Thus, the torque applied to drill bit 20 is maintained at a predetermined constant level through variations in rock property and bit dullness by selectively varying the weight applied to the drill bit as described above. It is to be appreciated that if weight in excess of the downhole motor and bit is necessary, additional weighted tubular members may be threadably engaged between housing 64 and tube 28 via threaded connection 30.

Figure 7:
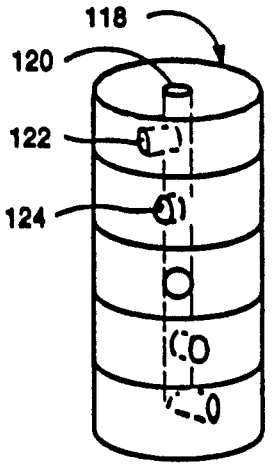
FIG. 7 is a perspective view of a portion of the hydraulic controls for another preferred embodiment of the apparatus of the invention.
Figure 8:
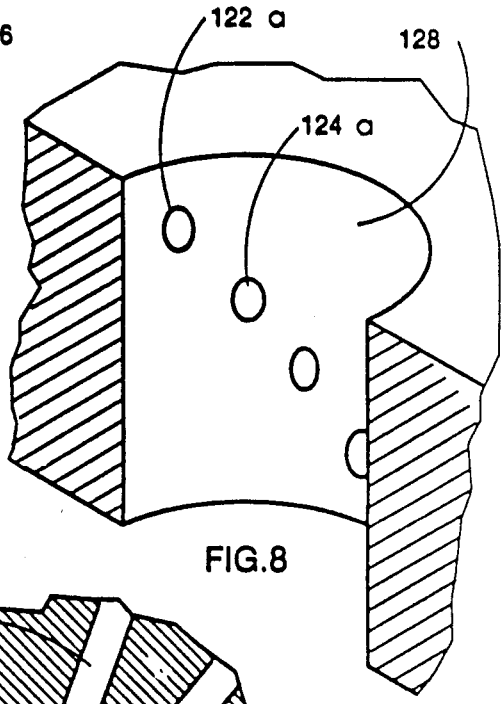
FIG. 8 is a perspective view of a portion of the embodiment of the apparatus of the invention which cooperates with the portion shown in FIG. 6.
Figure 9:
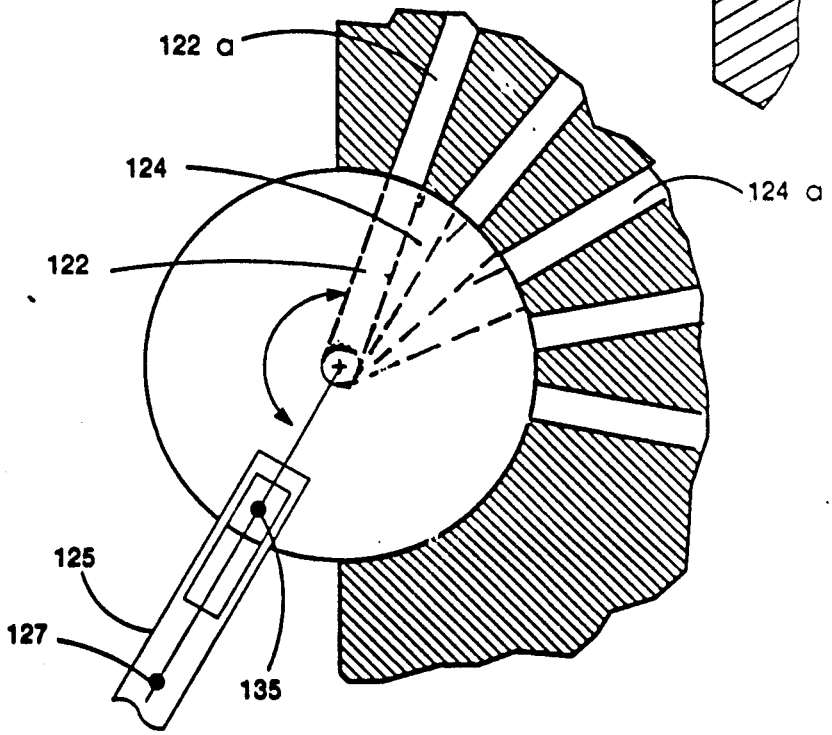
FIG. 9 is a top plan view of the portions shown in FIGS. 7 and 8 abutted against one another in operative condition.

Turning now to FIGS. 7, 8, and 9, illustrated therein is another form which selector 104 (in FIG. 4) may take. In FIG. 7, a cylindrical rotatable valve body 118 includes a central bore 120 which extends downwardly along the axis of the valve body. Bore 120 is in fluid communication with conductor 106 in FIG. 4. The bore extends into valve body 118 to a point just above the lower end of the valve body. A plurality of bores, like bores 122, 124 extend radially inwardly from the surface of body 118 and communicate with bore 120. Valve body 118 is operatively connected to linkage 125 (in FIGS. 5 and 7) so as to rotate in response to relative rotation between inner housing 64 and outer housing 66 in the same fashion as actuator selector 114 in FIG. 5 is rotated.

Indicated generally at 126 in FIG. 8 is a valve seat 126. Valve seat 126 includes a semicylindrical portion 128 which is of a size sufficient to just receive valve body 118. A plurality of bores, like bores 122a, 124a are formed in cylindrical portion 128. Each of the bores, like bores 122a, 124a, in cylindrical portion 128 are connected to a different one of the conductors, like conductors 100, 102, on the conductor end opposite that which is connected to downhole motor 16 in FIG. 4. In FIG. 9, valve body 118 is shown received with cylindrical portion 128.

It is to be appreciated that for the sake of clarity in the drawing of the selector shown in FIGS. 7-9 that only a limited number of valve seat bores, like bores 122a, 124a, and the corresponding bores, like bores 122, 124, in the valve body have been shown; however, for proper operation, it is necessary that for each conductor, like conductors 100, 102 (in FIG. 4), there is a corresponding bore, like bores 122a, 124a, in cylindrical portion 128 and, in turn, a corresponding bore, like bores 122, 124 in valve body 118.

The operation of the embodiment of FIGS. 7-9 is similar to that of the previously-described embodiment. During drilling, reactive torque causes downhole motor 16 and outer housing 66 to rotate relative to inner housing 64. When the hydraulic fluid pressure in FIG. 3 is greater than the pressure in reservoir 129, linkage 125 rotates valve body 118. As the valve body moves within seat 128, different conductors, like conductors 100, 102, are connected via bores, like bores 122a, 124a, in the seat to bores, like bores 122, 124, in the valve body and from there via bore 120 are connected to conductor 106. As in the previously described embodiment, variations in the reactive torque displace outer housing 66 relative to inner housing 64 and thereby cause different fluid pressures from the downhole motor to be selectively applied via selector 104 to cylinder 42 thus vary in the weight applied to the drill bit to obtain the desired torque level in the bit regardless of bit wear and changing rock characteristics.

Figure 10:
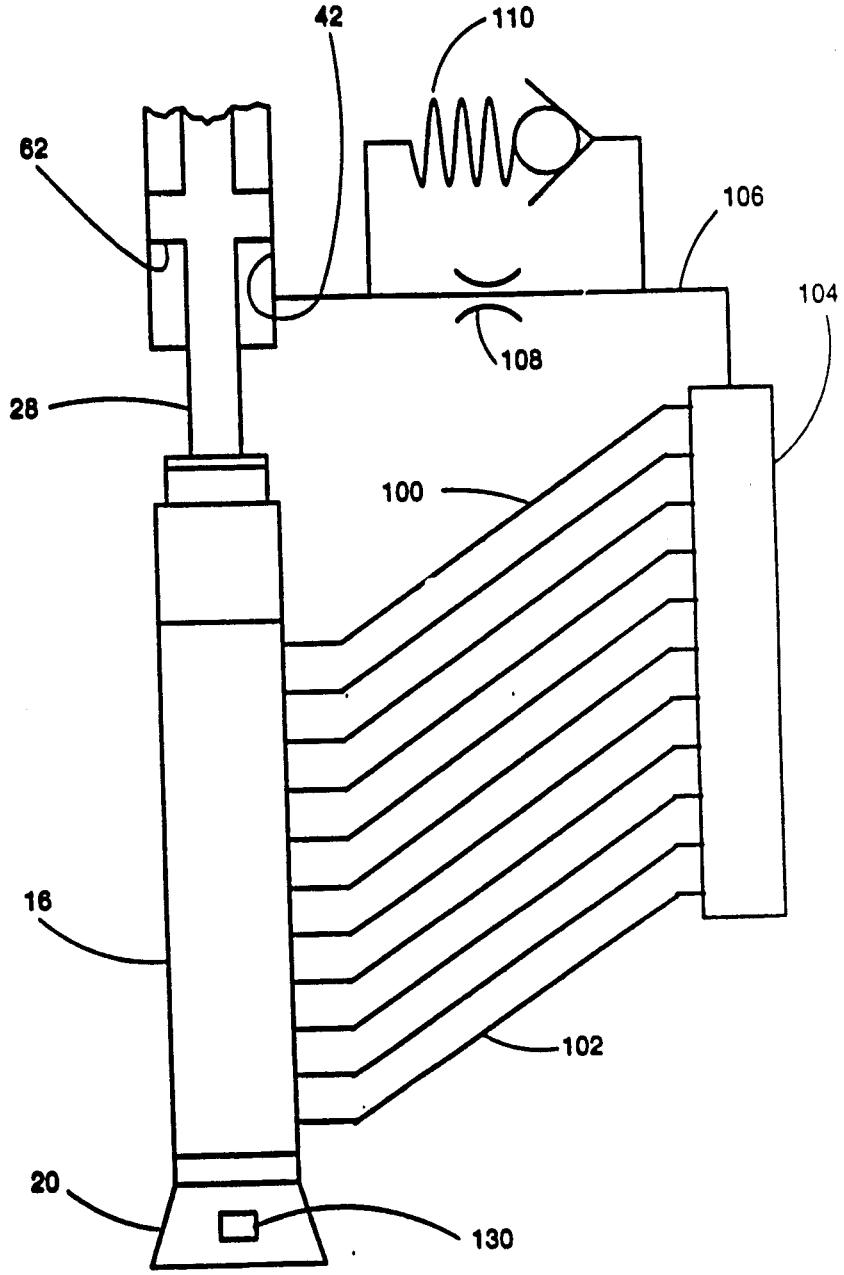
FIG. 10 is a somewhat schematic diagram of the hydraulic controls of still another preferred embodiment of the apparatus of the invention.

Another embodiment of the apparatus of the invention is shown in FIG. 10. The embodiment of FIG. 10 is similar to that of FIG. 4 except for the deletion of torque sensor 26 in the embodiment of FIG. 10. In FIG. 10, tube 28 is firmly threadably engaged with the upper end of downhole motor 16. In the place of torque sensor 26, a commercially available torque sensor 130 is mounted on drill bit 20. Torque sensor 130 produces an electrical signal proportional to the torque in drill bit 20. The torque sensor does not necessarily have to be at the bit as shown in FIG. 10; an alternate embodiment would be to sense the reactive torque above the downhole motor.

FIG. 10 also includes a selector 104 which serves the same function as selector 104 in FIG. 4, that is, it provides fluid pressure from the downhole motor in one of the conductors, like conductors 100, 102, to cylinder 42 via conductor 106. However, the form of selector 104 is different from that of previous-described embodiments and is illustrated in FIG. 11.

Figure 11:
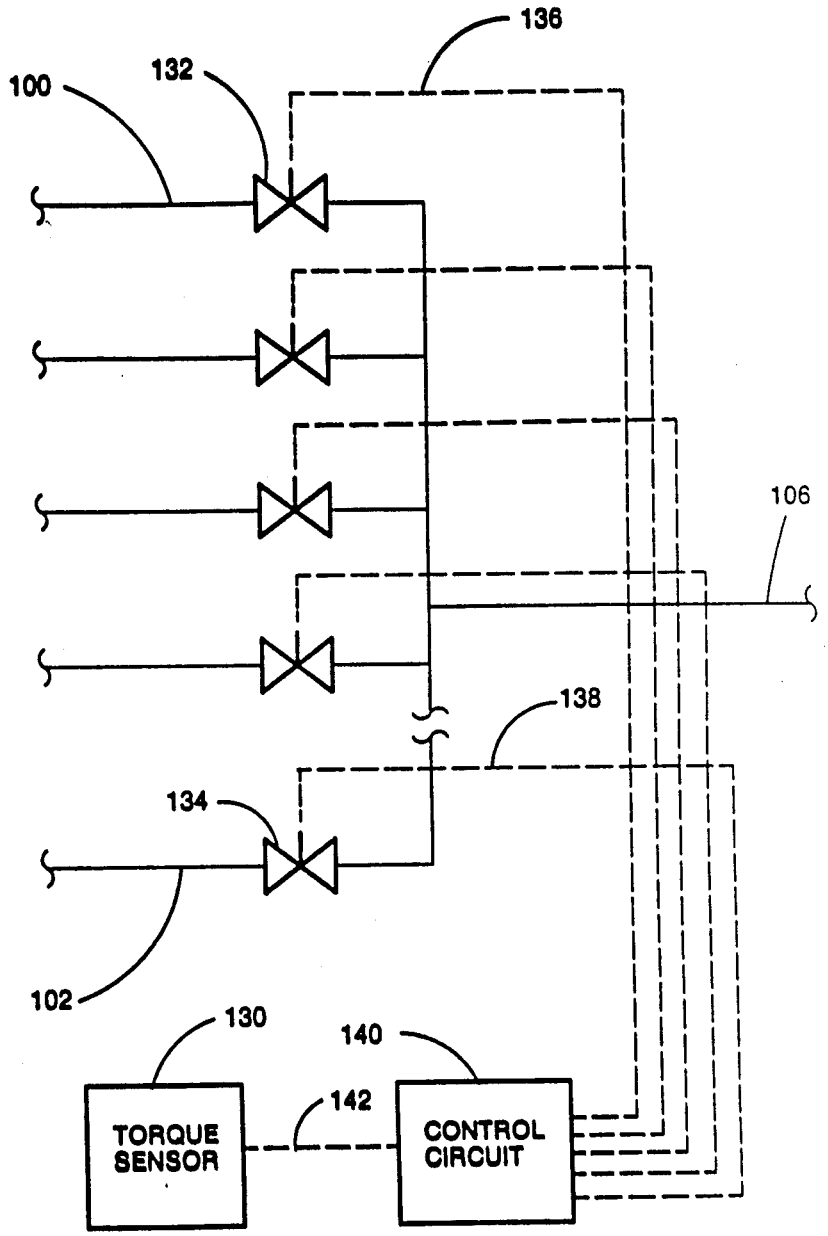
FIG. 11 is a schematic diagram of additional hydraulic and electronic controls for the embodiment of FIG. 6.

In the embodiment of FIG. 11, the conductors from different points along the length of downhole motor 16, like conductors 100, 102, are each connected to a plurality of electrically-controlled values, like valves 132, 134. Each of the vales is in a normally-closed condition until it receives an electrical signal on a line connected o the valve, like lines 136, 138 are connected to valves 132, 134, respectively. These lines are connected to the output of a control circuit 140. Control circuit 140 in turn receives an input signal from torque sensor 130 on line 142 which connects the torque sensor with the control circuit. Control circuit 140 may be constructed

BEST AVAILABLE COPY by a person having ordinary skill in the art to generate a signal on one and only one of the lines, like lines 136, 138, to energize one of the valves. Torque sensor 130 produces an increasing signal on line 42 in response to increasing torque. The control circuit opens a selected valve for a torque signal within a predetermined range. As the signal on line 142 increases, the control circuit opens valves which are associated with progressively higher pressure conductors connected to the downhole motor.

In operation, increasing torque above a preselected level causes control circuit 140 to open one of the valves, like valves 132, 134, which is connected to a higher-pressure conductor which in turn increases the pressure in cylinder 42 thereby decreasing the weight applied to the drill bit and thus the torque. Likewise, if the torque drops below the preselected level, the control circuit opens a valve connected to a lower-pressure conductor thus decreasing the pressure in cylinder 142 and increasing the weight applied to the bit and thus the torque.

Another embodiment of the invention is shown in FIG. 12. The embodiment of FIG. 12 is similar to that of FIG. 4 in that torque sensor 26 is received between tube 28 and the top of downhole motor 16 as in the embodiment of FIG. 4. Numbers corresponding to structure described in the embodiment of FIG. 4 are used to identify similar structure in FIG. 12. In the embodiment of FIG. 12, there is only one conductor, conductor 100, which is connected to the downhole motor to provide a source of pressurized drilling fluid. Conductor 100 is connected near the top of the downhole motor and thus provides fluid at very nearly the highest pressure available. Conductor 100 is connected to a pressure throttling valve 144. Valve 144 is operated via a mechanical actuator 146 which is operatively connected to torque sensor 26 and which is actuated responsive to relative rotational movement of inner housing 64 and outer housing 66 of the torque sensor. The mechanical actuator 146 could also be made to operate in response to an electrical signal designed to act in response to an electrically measured torque signal. As actuator 146 moves, pressure from conductor 100 is throttle to the annulus pressure to a degree dependent upon the position of actuator 146. Thus, pressure in line 106, and so the pressure in cylinder 142, continuously varies responsive to relative rotational movement of housings 64, 66. Valve 144 is constructed so that increasing angular displacement of housing 64, (which as will be recalled results from increasing torque) causes less of the pressure in conductor 100 to be throttled to the annulus so as to increase the pressure in conductor 106 and cylinder 42 which reduces the weight applied to the bit and thus the torque. Likewise, a decreasing torque signal causes a decrease in the pressure of conductor 106 and thus cylinder 42 thereby increasing the weight applied to drill bit 20. In the same manner as previously-described embodiments, the embodiment of FIG. 12 automatically varies the weight applied to the drill bit in response to drill bit torque in order to maintain a constant preselected torque level in the drill bit.

In FIG. 13, a final embodiment of the invention is shown. Previously-described structure is identified with the same number as used in FIG. 12. Indicated generally at 148 is a fluidic control circuit. The circuit is a monostable multivibrator which generates an output that is provided to cylinder 42 via conductor 106. The output consists of either one of two states: drilling fluid supplied from conductor 100 at a relatively high pressure or drilling fluid supplied from a conductor 150 which is in fluid communication with relatively low pressure drilling fluid in the annulus. Varying the length of the high pressure pulse varies the apparent dynamic pressure in cylinder 42 in a manner which permits linear control of the weight applied to the drill bit.

A spring-loaded, pressure-controlled, four-way valve 152 is biased by spring 154 into the position shown. When high pressure appears in conductor 153, valve 152 is urged to its other condition. A check valve 156 permits unrestricted flow to the right, as viewed in FIG. 12, through the conductors to which it is connected and completely restricts flow to the left. A spring-loaded, two-way valve 158 is biased by spring 160 to the position shown in FIG. 12. Valve 158 is mechanically connected to a rod 162 which in turn is connected to a piston 164 that is slidably received within a cylinder 166. Flow-restricting orifices 168, 170, 172 are disposed in various conductors in the circuit as shown. A pressure throttling valve 174 selectively vents pressure in conductor 176 to the annulus thereby varying the pressure in conductor 178 dependent upon the degree of venting. Valve 174 is controlled via a mechanical actuator 180 which is operatively connected to torque sensor 26. Actuator 180 controls valve 174 by increasing throttling in response to increasing relative angular displacement of housing 64, 66 in torque sensor 26 (which indicates increasing torque).

In operation, cylinder 166 is pressurized with fluid provided through valve 174. The cylinder is pressurized at a rate which depends on the position of actuator 180. At high torque levels, as detected by torque sensor 26, the cylinder is rapidly pressurized. Pressurization of cylinder 166 shifts valve 158 into its other condition and applies pressure from conductor 100 to conductor 153 thereby shifting valve 152 to its other condition. When such occurs, high pressure from conductor 100 is supplied to conductor 106 and to cylinder 42. Such high pressure is also applied through check valve 156 to the other side of piston 164 in cylinder 166 thus moving the piston downwardly to its original position. Once piston 164 returns to the condition shown in FIG. 12, valve 174 again pressurizes cylinder 166 beneath piston 164 at a rate dependent upon the sensed torque.

Control circuit 148 produces the same result as previously-described embodiments. That is, by varying the duty cycle of the high pressure fluid applied to cylinder 42 in response to detected drill bit torque, the weight applied to the drill bit 120 is selectively varied in order to maintain a desired torque level in the drill bit.

The the present invention is well adapted to obtain the advantages mentioned, as well as those inherent therein. It is to be appreciated that variations or modifications may be made to the methods and apparatus disclosed herein without departing from the spirit of the invention which is defined in the following claims:

What is claimed is:

1. A method for controlling the rotational torque of a drill bit in a wellbore powered by a hydraulic motor suspended from the lower end of a string of drill pipe through which drilling fluid is pumped, comprising the steps of:

sensing the torque applied to said drill bit at a location within the wellbore adjacent said drill bit;

generating fluid pressure in a chamber disposed within the wellbore responsive to the sensed torque level; and

BEST AVAILABLE COPY using said generated fluid pressure to vary the weight applied to said drill bit.

2. The method of claim 1 wherein the step of using said generated fluid pressure to vary the weight applied to said drill bit comprises the step of applying an upward force to said drill bit.

3. The method of claim 1 wherein the step for generating fluid pressure in the chamber responsive to the sensed torque level comprises the step of tapping drilling fluid from said hydraulic motor at a pressure between that of the hydraulic motor input and output fluid pressures.

4. The method of claim 1 wherein the step of using said fluid pressure comprises the step of throttling the hydraulic motor input pressure to a selected lower pressure.

5. The method of claim 1 wherein the step of generating fluid pressure in the chamber responsive to the sensed torque level comprises the step of moderating the direction of drilling fluid pressure pulses.

6. An apparatus to be disposed within a wellbore for controlling the rotational torque of a drill bit in the wellbore of the type which can be powered by a hydraulic motor suspended from the lower end of a string of drill pipe through which drilling fluid is pumped, said apparatus in operative condition comprising:

a body adapted for interconnection with the drill pipe at an upper end theeof and to the hydraulic motor at a lower end thereof, the body including:

means for sensing the torque applied to said drill bit at a location within the wellbore adjacent said drill bit;

a chamber;

means for generating fluid pressure in said chamber responsive to the sensed torque level; and means for varying the weight applied to said drill bit responsive to said generated fluid pressure.

7. The apparatus of claim 6 wherein said means for varying the weight applied to said drill bit comprises means for applying an upward force to said drill bit.

8. The apparatus of claim 6 wherein said means for generating fluid pressure in said chamber responsive to the sensed torque level comprises means for tapping drilling fluid from said hydraulic motor at a pressure between that of the hydraulic motor input and output fluid pressures.

9. The apparatus of claim 6 wherein said means for varying the weight comprises means for throttling the pressure of the drilling fluid of the downhole motor input to a selected lower pressure.

10. The apparatus of claim 6 wherein said means for generating fluid pressure in the chamber responsive to the sensed torque level comprises means for modulating the duration of drilling fluid pressure pulses.

11. A method for controlling the rotational torque of a drill bit in a wellbore powered by a hydraulic motor suspended from the lower end of a string of drill pipe, said hydraulic motor being powered by high pressure drilling fluid supplied thereto through said drill pipe, said drilling fluid exiting said hydraulic motor at a relatively low pressure, said method comprising:

sensing the torque applied to the drill bit at a location within the wellbore adjacent said drill bit;

diverting within the wellbore a portion of said high and low pressure drilling fluids from and to locations within the wellbore; and directing said diverted drilling fluid to means within the wellbore for varying the weight applied to said drill bit in response to the sensed torque level.

12. The method of claim 11 wherein the step of using said diverted drilling fluid to vary the weight applied to said drill bit responsive to the sensed torque level comprises the step of applying an upward force to said drill bit.

13. The method of claim 11 wherein the step of diverting some of said drilling fluid at a pressure selected between said high and low pressure level comprises the step of diverting said fluid at said high pressure level.

14. The method of claim 13 which further comprises the step of throttling the pressure of said diverted fluid to a selected lower pressure.

15. The method of claim 13 which further comprises the step of selectively varying the length of time during which said high pressure fluid is diverted.

16. The method of claim 11 wherein the step of diverting some of said drilling fluid at a pressure between said high and low pressure levels further comprises the step of selecting said diverted drilling fluid pressure responsive to the sensed torque level.

17. An apparatus for controlling the rotational torque of a drill bit in a wellbore of the type which can be pwoered by a hydraulic motor suspended from the lower end of a string of drill pipe, said hydraulic motor, when so suspended, being powered by high pressure drilling fluid supplied thereto through said drill pipe, said drilling fluid exiting said hydraulic motor at a relatively low pressure, said apparatus in operative condition comprising:

a body adapted for interconnection with the drill pipe at an upper end thereof and to the hydraulic motor at a lower end thereof, the body including:

means for sensing the torque applied to said drill bit at a location within the wellbore adjacent said drill bit;

means for diverting some of said drilling fluid at a pressure selected between said high and low pressure levels from and to locations within the wellbore; and means for using said diverted drilling fluid to vary the weight applied to said drill bit responsive to the sensed torque level.

18. The apparatus of claim 17 wherein said means for using said diverted drilling fluid to vary the weight applied to said drill bit responsive to the sensed torque level comprises means for applying an upward force to said drill bit.

19. The apparatus of claim 17 wherein said means for diverting some of said drilling fluid at a pressure selected between said high and low pressure levels comprises means for diverting said drilling fluid at said high pressure level.

20. The apparatus of claim 19 which further comprises means for throttling the pressure of said diverted drilling fluid to a selected lower pressure.

21. The apparatus of claim 19 which further comprises means for selectively varying the length of time during which said high pressure fluid is diverted.

22. The apparatus of claim 17 wherein said means for diverting some of said drilling fluid at a pressure selected between said high and low pressure levels comprises means for selecting said pressure responsive to the sensed torque level.

23. Apparatus for controlling the rotary torque of a drill bit in a wellbore of the type which may be powered

BEST AVAILABLE COPY by a hydraulic motor connected to the lower end of a string of drill pipe, said hydraulic motor, when so connected, being powered by high pressure drilling fluid supplied thereto through said drill pipe, said drilling fluid existing said hydraulic motor at a relatively low pressure, said apparatus in operative condition comprising:

mean for defining a cylinder connected to the lower end of such a drill pipe, said cylinder being coaxial with the drill pipe when so connected;

a piston slidably received within said cylinder;

a tube mounted on said piston and extending downwardly therefrom, said tube having contracted and extended positions;

means for constraining said tube against rotational movement;

means for detecting reactive torque in said tube;

means for connecting a hydraulic motor to said means for detecting reactive torque; and means for supplying drilling fluid at a selected pressure to said cylinder below said piston, said pressure being selected responsive to the detected torque.

24. The apparatus of claim 23 wherein said apparatus further comprises means for providing said selected pressure at a pressure between said high pressure drilling fluid and said relatively low pressure drilling fluid.

25. The apparatus of claim 24 wherein said means for providing said selected pressure at a pressure between said high pressure drilling fluid and said relatively low pressure drilling fluid comprises a valve for throttling said high pressure drilling fluids to a selected lower pressure.

26. The apparatus of claim 24 wherein said means for providing said selected pressure at a pressure between said high pressure drilling fluid and said relatively low pressure drilling fluid comprises means for modulating the duration of drilling fluid pressure pulses.

27. The apparatus of claim 23 wherein said apparatus further comprises means for providing an indication that said tube is approaching its contracted condition.

28. The apparatus of claim 27 wherein said means for providing an indication that said tube is approaching its contracted condition comprises means for partially obstructing drilling fluid flow thereby creating a drilling fluid pressure pulse detectable at the surface of the well.

29. The apparatus of claim 23 wherein said means for detecting reactive torque in said tube comprising:

an inner housing mounted on the lower end of said tube;

an outer housing mounted on said inner housing, said outer housing being rotatable relative to said inner housing;

fluidic ram disposed between said inner and outer housings, said ram being contracted and extended in response to relative rotation of said housings;

a first fluid reservoir operatively connected to said ram, said first fluid reservoir pressure varying in response to ram contraction and extension;

a second fluid reservoir having a preselected pressure, and a slidable member disposed between the fluids in said first and second reservoirs.

* * * * *